US005566837A

United States Patent [19]

Lema

[11] Patent Number: 5,566,837

[45] Date of Patent: Oct. 22, 1996

[54] BALL CAP STORAGE AND DISPLAY RACK

[76] Inventor: Greg Lema, 4022 Glendale Ct., Merced, Calif. 95348

[21] Appl. No.: 213,559

[22] Filed: Mar. 16, 1994

[51] Int. Cl.[6] ..... A47F 7/06

[52] U.S. Cl. ..... 211/33; 211/31; 211/32; D6/317

[58] Field of Search ..... 211/30–33, 106, 211/119, 205, 181; 248/175; D6/317, 318, 319, 320, 323, 327

[56] References Cited

U.S. PATENT DOCUMENTS

| | | | |
|---|---|---|---|
| 700,907 | 5/1902 | Edwards | 211/30 |
| 887,401 | 5/1908 | Klotz | 211/181 X |
| 3,999,821 | 12/1976 | Moody et al. | 211/119 X |
| 5,002,190 | 3/1991 | Moreland | 211/181 X |
| 5,121,842 | 6/1992 | Osborne | 211/30 X |
| 5,303,829 | 4/1994 | Kennedy | 211/30 |

*Primary Examiner*—Korie Chan
*Attorney, Agent, or Firm*—Claude A. S. Hamrick

[57] ABSTRACT

A hat rack including a vertical rod with a loop at the top for hanging the rack on a wall. Separate rack sections are attached to the vertical rod, and spaced apart at intervals, each section for storing a single cap. A section includes two rods extending out from the vertical rod at an angle to each other forming a triangular shaped cap support structure with a tie rod extending between them for strength, and each rod having an upwardly protruding end for captivating a cap visor placed on the rods. A short rod is positioned above each pair of outwardly protruding rods, extending outward from the vertical rod in a direction parallel to an axis half way between the outwardly protruding rods, and spaced above them so as to be useful for supporting the top portion of a cap. The invention meets a particular need of those who collect numerous baseball caps and desire to have them individually displayed.

18 Claims, 6 Drawing Sheets

BALL CAP STORAGE AND DISPLAY RACK

BACKGROUND OF THE INVENTION

1. Field of the Invention

The present invention relates generally to hat and cap storage and display devices, and more particularly to a cap storage rack for storing a plurality of baseball-type caps or the like, including separate rack sections for each cap, each section having a cap dome support pin and a triangular or trapezoidal shaped visor support structure with two vertical captivation members for bearing against a visor to retain a cap, the device being configured for hanging on a wall, or from a ceiling, or for mounting on a base.

2. Description of the Prior Art .

Numerous methods and apparatus have been used in the past for storing hats, both individually and in groups. Storage of collections of caps or hats on various types of hooks is a common practice, and some such apparatus have been made the subject of patents. One such patent is entitled "STORAGE DEVICE" by Davis (U.S. Pat. No. 4,993,557) and addresses the problem of storing a plurality of baseball-type caps in a vertical stack arrangement. Access to a particular cap requires removal of caps disposed above it, and identification of an individual cap is somewhat obscured. A cap Shaping And Drying Apparatus for a single cap is described by Hale et al. (U.S. Pat. No. 4,805,782), the visor pointing upward and held by a clip. A device for storing lids for kitchen pots and pans by J. C. Brown (U.S. Pat. No. 2,633,994) and a saddle rack by Patton (U.S. Pat. No. 4,421,238) are made from bent wire tubing.

Not addressed by the prior art is the provision of a single rack for storing a plurality of caps with each cap separately visible and mounted to display the visor and front portion for ease of identification.

SUMMARY OF THE PRESENT INVENTION

It is therefore an object of the present invention to provide a novel apparatus for storage of a plurality of baseball-type caps with each cap separately displayed.

Another object of the present invention is to provide an apparatus for storage of baseball type caps so that when in use the visor of each cap is positioned in a plane for displaying the front of each cap.

A further object of the present invention is to provide a cap storage apparatus of the type described that can be conveniently mounted on a wall.

A still further object of the present invention is to provide a cap storage apparatus of the type described that can be conveniently hung from a ceiling.

Another object of the present invention is to provide a cap storage apparatus of the type described that can be conveniently mounted on a base or platform.

Briefly, a presently preferred embodiment of the present invention is comprised of a wire or rod stock frame including a vertical rod with a loop at the top for hanging the rack on a wall. Separate rack sections are attached to the vertical rod, and spaced apart at intervals, each section for storing a single cap. A section includes two rods extending out from the vertical rod at an angle to each other forming a triangular shaped cap support structure with a tie rod extending between them for strength, and each rod having an upwardly protruding end for captivating a cap visor placed on the rods. A short rod is positioned above each pair of outwardly protruding rods, extending outward from the vertical rod in a direction parallel to an axis half way between the outwardly protruding rods and spaced above them so as to be useful for supporting the top portion of a cap.

The invention meets a particular need of those who collect numerous baseball caps and desire to have them individually displayed.

An advantage of the present invention is that it can be easily hung from a wall or from a ceiling or other member.

A still further advantage of the present invention is the ease of access to any particular cap without the need to remove the other caps.

These and other objects and advantages of the present invention will no doubt become apparent to those skilled in the art after having read the following detailed description of the preferred embodiment which is illustrated in the several figures of the drawing.

IN THE DRAWING

DETAILED DESCRIPTION OF THE PREFERRED EMBODIMENT

Figure 1:
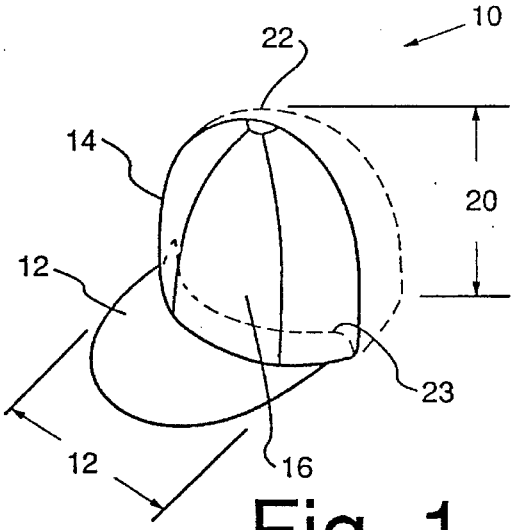
FIG. 1 is an illustration of a baseball cap in both usable and collapsed configuration.

Referring now to FIG. 1 of the drawing, a baseball cap is shown at 10 including a visor or bill 12 and flexible head-covering portion 14 with a frontal face 16. The cap has a width determined by the width 18 of visor 12 and an effective height 20 determined by the height of the cap body 14 above the plane of the visor 12. To prepare a cap of the type illustrated for storage in accordance with the present invention, the rearmost portion shown by dashed line 22 of the cap body will be folded forward into the front portion thereof as indicated at 23 so as to assume the shape illustrated.

Figure 2:
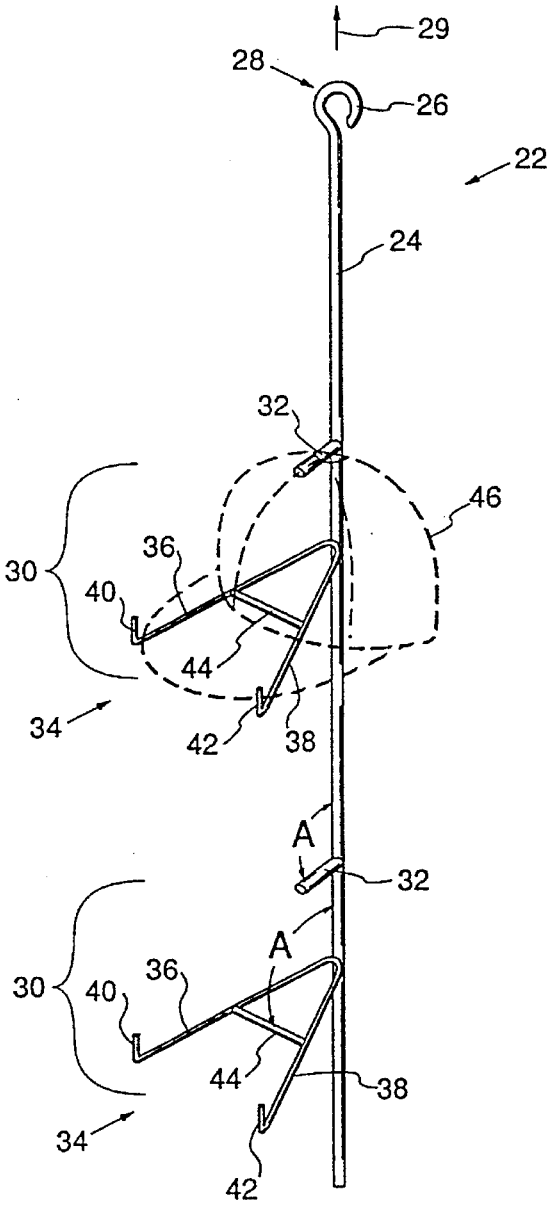
FIG. 2 is an illustration of an embodiment of the present invention for hanging on a wall or from a ceiling and constructed with wire, rod or tubular stock.

Turning now to FIG. 2, a preferred embodiment of the present invention is depicted at 22 in a form as might be fabricated from rod or tubular stock. There is an elongated vertical support member 24, the length of which defines a first axis 25, with a loop 26 at the top end 28 for hanging on a wall or from a ceiling or other structure. Distributed along the length of the member 24 are two rack sections 30, each including a cap body support 32 and a platform 34. Although two sections 30 are shown, the spirit of the invention includes any number. The platform 34 is shown to be of triangular shape and constructed from two rods 36 and 38 extending out at an obtuse angle "A" from the vertical rod 24, the longer portions forming a structure defining a support plane for holding a cap visor, and having upwardly protruding ends 40 and 42 providing captivation means for securing the visor on the structure. The obtuse angle "A", preferably 96 degrees, causes a cap visor 12 to bear against the ends 40 and 42 and provides a better display of the cap front 16. The rods 36 and 38 are joined together with a tie rod 44 for added strength, the combination forming the platform 34 for support of the visor of a cap as indicated by the dashed outline 46. The cap body 14, shown folded in on itself, is supported by the cap body support 32 configured as a short rod attached to and extending outward from the vertical rod 24 in a plane parallel to a plane defined by the rods 36 and 38. Each cap body support lies above its corresponding platform 34 and extends in a direction parallel to an axis in the support plane equidistant between the two rods 36 and 38.

Figure 3:
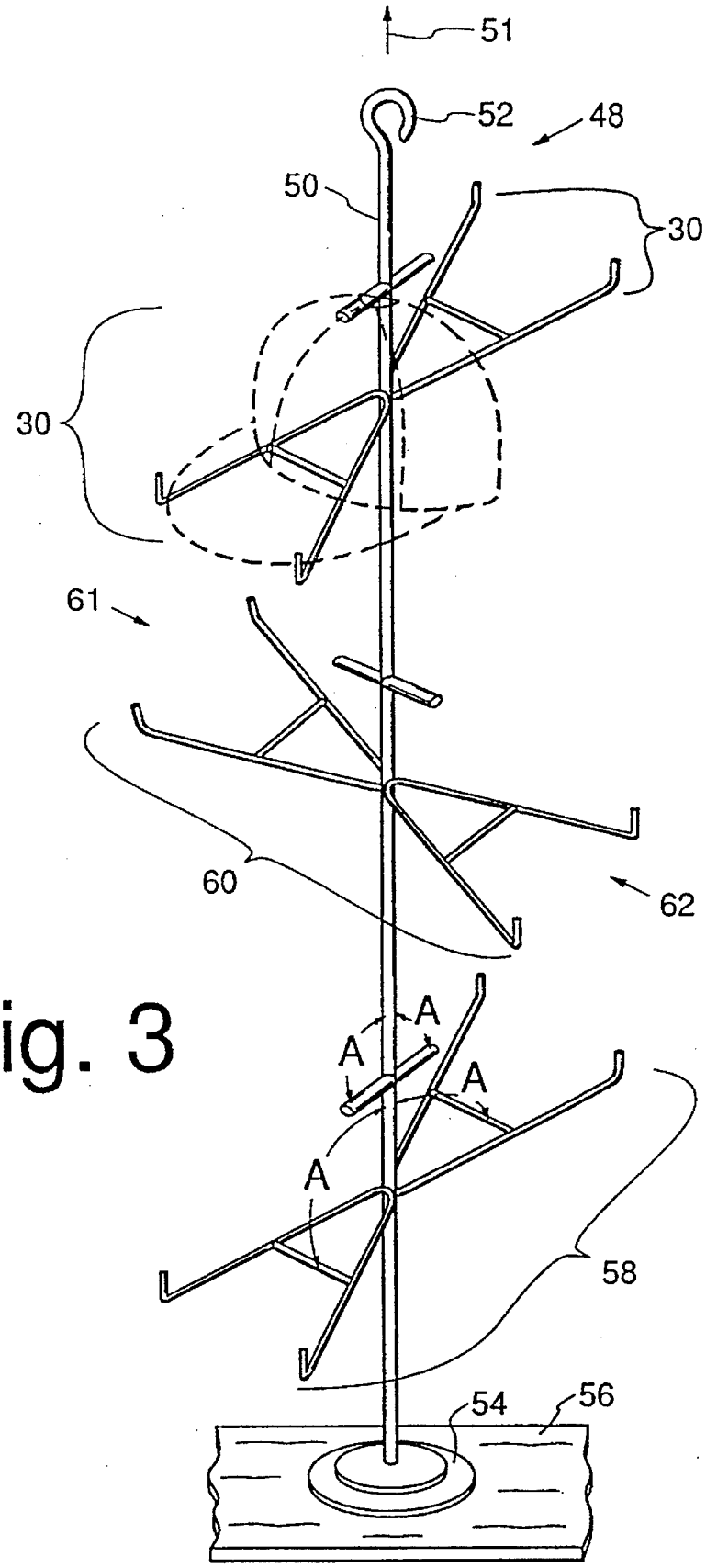
FIG. 3 is a view of an embodiment of the present invention with multiple rack sections arranged around a vertical rod that can be hung from a ceiling or the like or supported on a base.

FIG. 3 illustrates an alternate embodiment 48 of the present invention including a vertically oriented rod 50 defines a first axis 51 with a loop 52 at the top for hanging from a structure such as a ceiling. The figure also illustrates a base 54 into which the rod 50 is inserted or attached for setting the rack 48 on a surface 56.

The rack 48 as illustrated has a plurality of rack sections 30 attached to the rod 50 and arranged in pairs such as 58 and 60. The rods 36 and 38 and 44, illustrated in FIG. 2 preferrably intersect the axis of rod 50 at an obtuse angle "A" as described in reference to FIG. 2. The pairs of sections such as 60 are oriented with one section such as 61 extending away from rod 50 at 180 degrees about the first axis 51 from the other section 62 of the pair. The pairs 58 are spaced apart along the rod 50, and oriented at 90 degrees about the first axis 51.

The specific orientation of the sections 30 as shown in FIG. 3 is given for illustration, the invention including other orientations of one section 30 relative to another. The obtuse angle A illustrated in FIG. 2 applies as well to FIG. 3 as a preferred embodiment. However, the spirit of the invention includes other angles less than or equal to 90 degrees.

Figure 4:
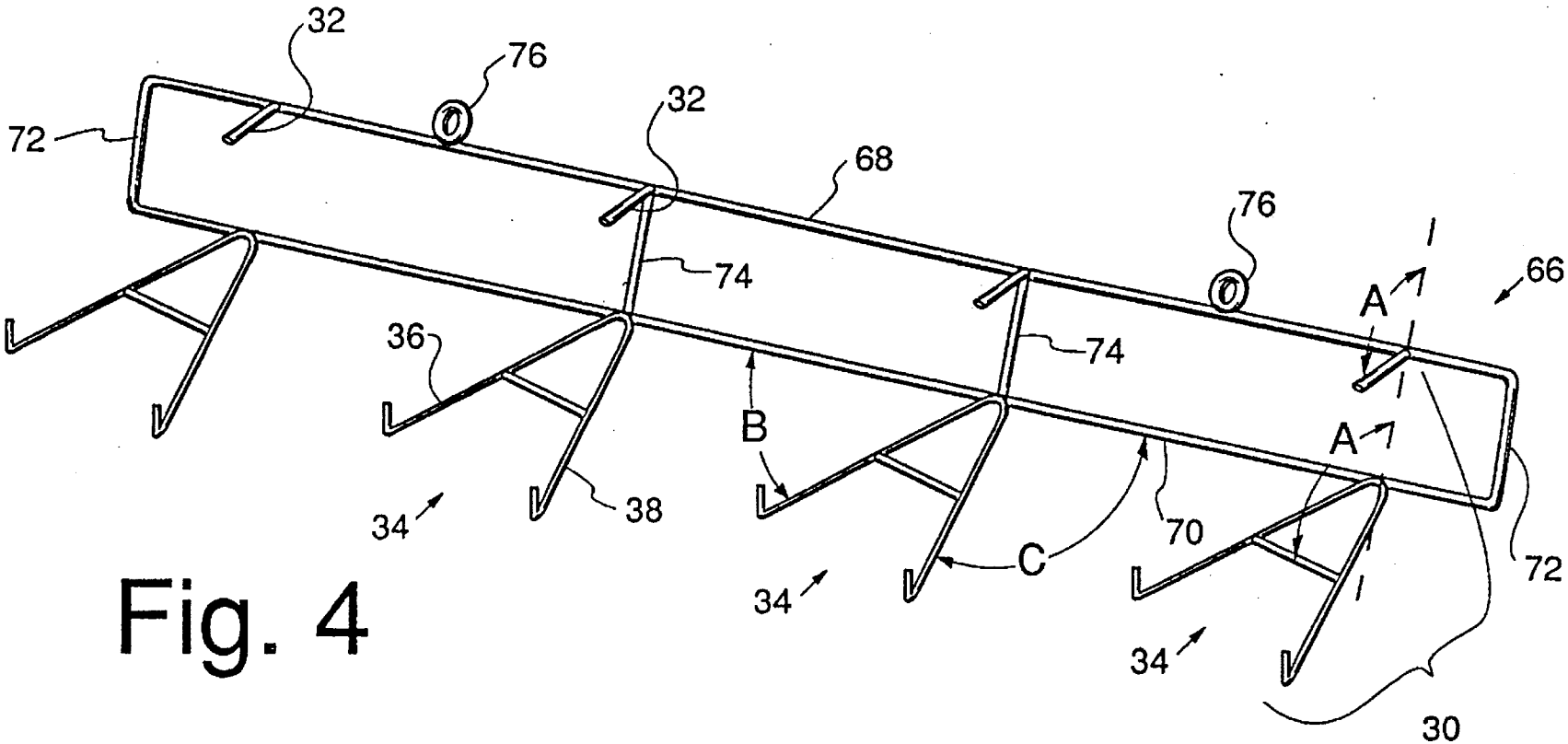
FIG. 4 is a view of an embodiment of the present invention wherein the rack sections are arranged in a row and mounted on a frame for hanging on a wall.

A further embodiment of the present invention is shown in FIG. 4 with the platforms 34 of sections 30 all lying in a single plane, and being attached to an elongated rectangular frame 66 defining a first plane and having an upper rod 68 and a lower rod 70 interconnected by end portions 72 and having additional supports 74 joining the upper and lower rods 68 and 70. The upper rod 68 has loops 76 attached thereto for use in mounting the frame 66 on a wall.

The cap body support rods 32 of each section 30 are attached to the upper rod 68 and extend outward at a preferred obtuse angle A to the first plane defined by the frame 66. The platforms 34 have the two rods 36 and 38 connected and oriented at equal angles B and C to the lower rod 70, and lie in a plane preferrably parallel to that defined by the cap support rod 32 and rod 68.

Figure 5:
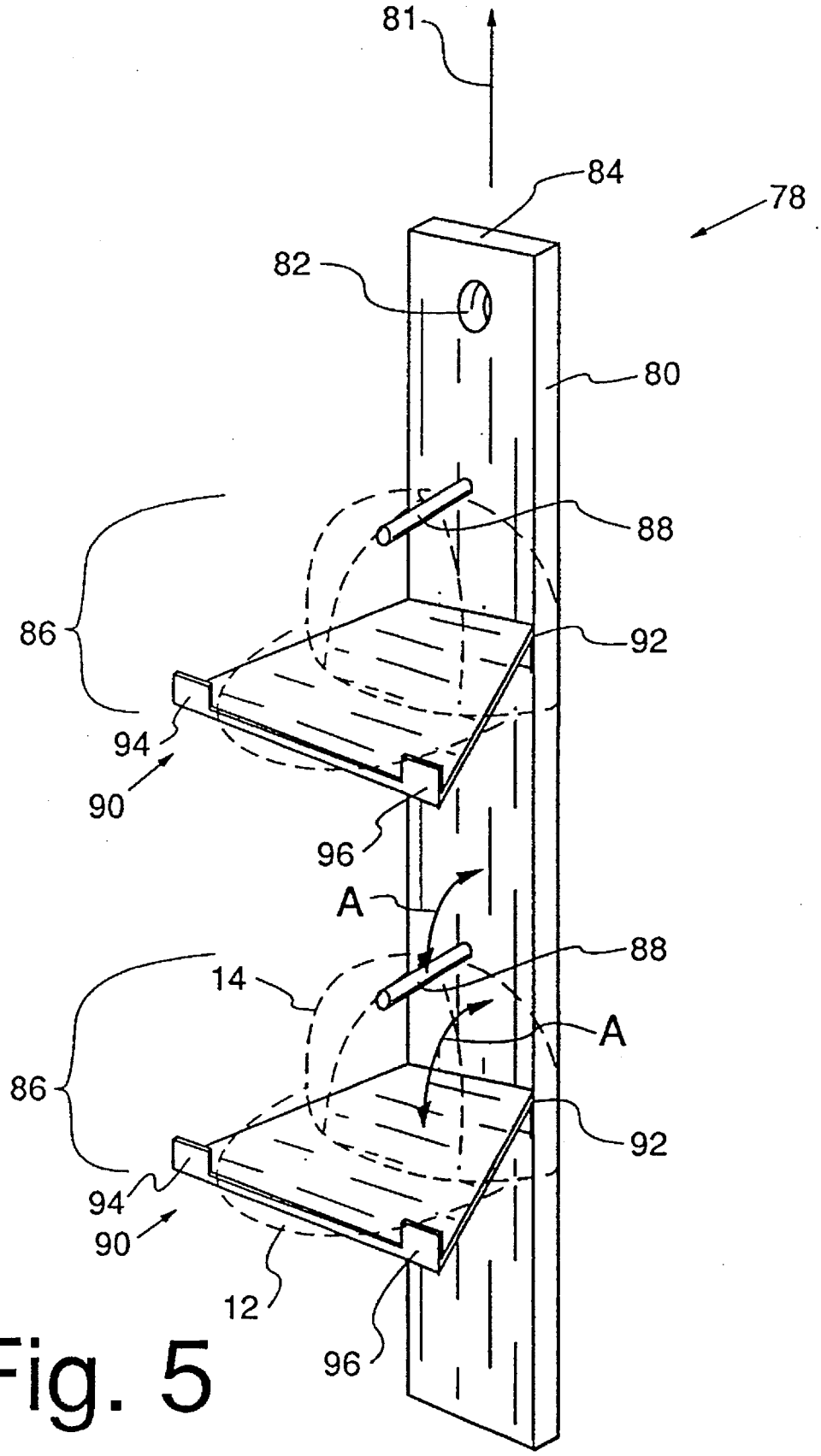
FIG. 5 is a perspective view showing a simplified embodiment illustrating the concept of the present invention in a wall hung vertical arrangement constructed from flat metal or plastic material.

Turning now to FIG. 5, an alternate embodiment of the present invention is depicted at 78 in a form as might be fabricated from sheet metal or sheet plastic. There is an elongated vertical support member 80 defining a first axis 81 with a mounting hole 82 near a top end 84. Distributed along the length of the member 80 are two rack sections 86, each including a cap body support 88 and a platform 90. The platform 90 is shown to be of trapezoidal shape, the narrow end 92 shown bent and attached to the vertical support member 80, but could also be a "but" joint, and can be secured by any of various means well known in the art such as the use of an adhesive for plastic, or welding for metal material. Each platform 90 has two upwardly protruding supports 94 and 96 located at outward extremities of the platform 90. The platforms 90 and cap supports 88 preferably intersect the support 80 at an obtuse angle A in a similar manner to FIGS. 2 and 3.

The figure also shows two caps (dashed lines) in their normal storage locations with the visor 12 resting on the platform 90 and being restrained by the upwardly protruding supports 94 and 96. Each cap body 14 is shown folded in on itself as in the solid line sketch of FIG. 1 and positioned over the corresponding cap body support 88.

Figure 6:
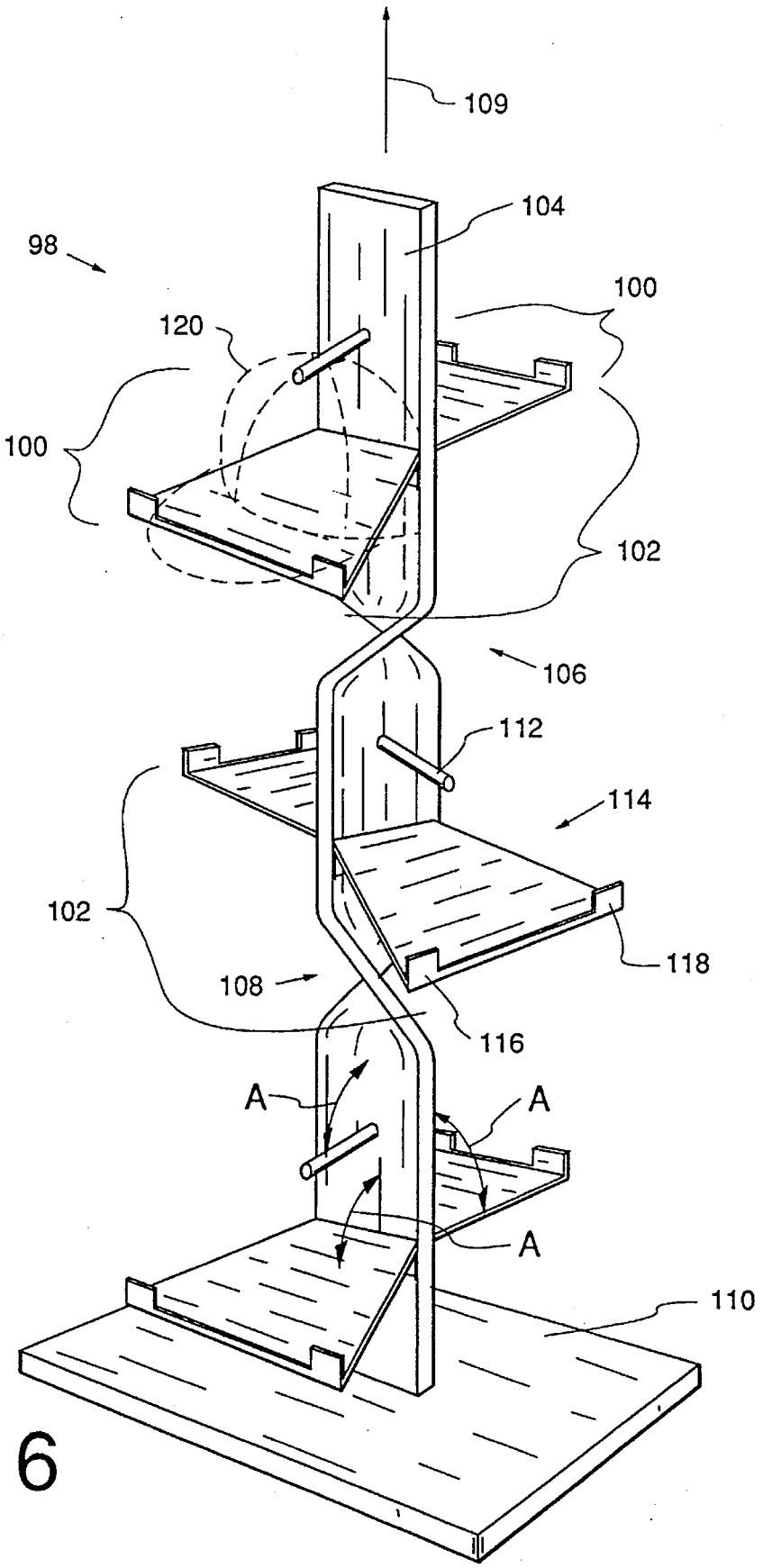
FIG. 6 is a view of an embodiment arranged similarly to FIG. 3 but constructed from flat stock.

FIG. 6 shows another embodiment 98 of the present invention constructed of flat stock, which like the embodiment of FIG. 5 can be of various materials. Rack sections 100 are shown in pairs 102, one rack section 100 on each side of a support member 104 which is twisted at points 106 and 108 to position alternate pairs 102 at 90 degrees to each other about a first axis 109 defined by the length of support member 104. The vertical support member 104 is shown attached to a base 110 to allow the embodiment 98 to sit on a table, floor or like surface.

Each rack section 100 has a cap body support 112 and a platform 114 which can be secured to the vertical support member 104 in various ways well known to those skilled in the art, such as welding if the material is metal. Each platform 114 has upwardly protruding tabs 116 and 118 for captivating a cap such as cap 120 shown with dashed lines, and defines a support plane intersecting the first axis 109 at an obtuse angle A, as also does the cap body support 112.

Figure 7:
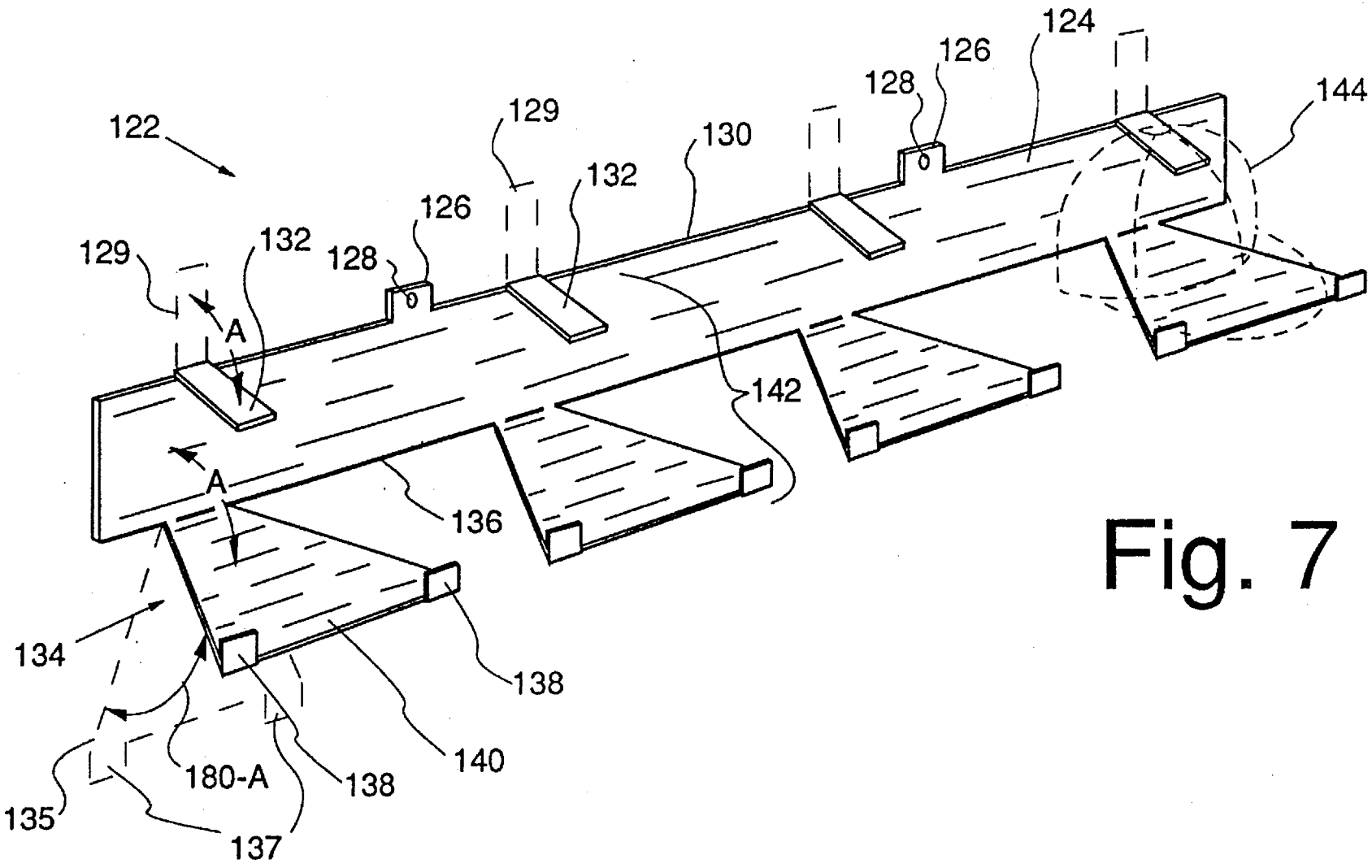
FIG. 7 is an illustration of an embodiment with an arrangement similar to that of FIG. 4 except constructed from flat stock.

FIG. 7 illustrates an embodiment 122 of the present invention formed from a single piece of flat stock and configured for mounting on a wall. There is a planar back section 124 defining a first plane with tabs 126 protruding therefrom with holes 128 for attachment to a wall or like surface. Extensions 129 (dashed lines) from the back section 124 are bent forward at angle "A" at top edge 130 to form the cap body supports 132. Trapezoidal shaped platforms 134 are formed by bending the material shown at 135 (dashed lines) through angle 180-A degrees at a bottom edge 136, and bending tabs 137 upwards from the surface 140 to form captivation tabs 138. The cap supports 132 and platforms 134 form rack sections 142 which all lie in a row to support caps such as cap 144 shown in dashed line form.

Although the present invention has been described above in terms of an embodiment fabricated from sheet metal or plastic and in various embodiments formed from rod, wire or tubing stock, it will be appreciated that other embodiments made from other materials or methods of fabrication could likewise be provided. A limited number of rack sections have been shown for ease of illustration, but the spirit of the invention includes any number. Accordingly, it is intended that the following claims be interpreted broadly to cover all alterations and modifications as fall within the true spirit and scope of the invention.

What is claimed is:

1. A rack for storing baseball caps having a visor extending forwardly from a head cover, comprising:

a vertically oriented support member of elongated shape having a length, and first and second ends;

attachment means for attaching said support member to a surface;

a plurality of rack section means attached to said support member at periodic intervals along said length, each rack section means including cap body support means attached to said support member for supporting the head cover of one of the baseball caps when the rear portion of the head cover is folded inwardly toward the visor;

cap visor supporting platform means attached to said support member beneath said cap body support means and in spaced apart relationship to said cap body support means for receiving and supporting the cap visor, said platform means including a generally horizontally extending structure defining a support plane intersecting said vertically oriented support member, said structure having a generally triangular or trapezoidal configuration with a base-like extremity and an apex-like opposite extremity, said opposite extremity being rigidly affixed to said support member, and captivation means extending upwardly from said base-like extremity and away from said support plane for captivating the visor of the cap placed on said structure with the head cover thereof folded and supported by said cap body support.

2. A rack for storing baseball caps as recited in claim 1 wherein said attachment means is a loop attached to said support member.

3. A rack for storing baseball caps as recited in claim 1 wherein each cap body support means is a rod extending from said support member and lying in a plane parallel to and above the support plane of a corresponding one of said structures.

4. A rack for storing baseball caps as recited in claim 3 wherein said structure is constructed from first and second rod means, each of said rod means having a first rod end attached to said support member and extending therefrom, said first and second rod means being oriented at an angle with respect to each other and lying in said support plane, and said first and second rods being interconnected by a tie rod.

5. A rack for storing baseball caps as recited in claim 4 wherein said captivation means is an extension of said first and second rod means bent so as to extend away from said support plane toward said cap body support.

6. A rack for storing baseball caps as recited in claim 5 wherein said support member is of a rod shape, and said length defining a first axis.

7. A rack for storing baseball caps as recited in claim 6 wherein said attachment means is a loop at said first end of said support member.

8. A rack for storing baseball caps as recited in claim 7 wherein said support plane intersects said first axis at an obtuse angle.

9. A rack for storing baseball caps as recited in claim 7 further comprising a base for attachment to said second end of said support member for setting said rack on a surface.

10. A rack for storing baseball caps as recited in claim 5 wherein said support member is an elongated rectangularly shaped frame defining a first plane constructed from rod stock, said length determined by an upper rod and lower rod with said lower rod lying in said support plane, said upper and lower rods spaced apart and connected together by said first and second ends formed from said rod stock;

said cap body support means is attached to said upper rod and extending therefrom;

said support plane intersects said first plane at an obtuse angle; and said first and second rod means are oriented to make equal angles with said lower rod and attached to said lower rod beneath a corresponding one of the cap body support means attached to said upper rod.

11. A rack for storing baseball caps as recited in claim 9 wherein the rack section means are attached to said support member in groups of first and second rack section means, said first rod ends being spaced equally from each other along said first axis, and said first rack section means oriented 180 degrees from said second rack section means, and alternate groups of first and second rack section means attached at said periodic intervals oriented at 90 degrees about said first axis from each other.

12. A rack for storing baseball caps having a visor extending forwardly from a head cover, comprising:

a vertically oriented support member of elongated shape having a length, and first and second ends;

attachment means for attaching said support member to a surface;

a plurality of rack section means attached to said support member at periodic intervals along said length, each rack section means including cap body support means attached to said support member for supporting the head cover of one of the baseball caps when the rear portion of the head cover is folded inwardly toward the visor;

cap visor supporting platform means attached to said support member beneath said cap body support means and in spaced apart relationship to said cap body support means for receiving and supporting the cap visor, said platform means including a generally horizontally extending structure defining a support plane intersecting said vertically oriented support member, said structure having a generally trapezoidal configuration with a base-like extremity and an apex-like opposite extremity, said opposite extremity being rigidly affixed to said support member, and captivation means extending upwardly from said base-like extremity and away from said support plane for captivation the visor of the cap placed on said structrue with the head cover thereof folded and supported by said cap body support.

13. A rack for storing baseball caps as recited in claim 12 wherein said support member is constructed from flat stock.

14. A rack for storing baseball caps as recited in claim 13 wherein said platform means is constructed from flat stock, with said captivation means formed by bending tabs formed from said flat stock away from the corresponding structure towards the corresponding cap body support.

15. A rack for storing baseball caps as recited in claim 14 wherein said support member is rectangular in shape defining a first plane and having an upper edge, and a lower edge defining a lower edge axis, said edges having a length equal to said length;

said body support means extends outward from said upper edge at an obtuse angle to said first plane; and said structure is attached to said lower edge, and said support plane intersects said first plane at an obtuse angle and includes said edge axis.

16. A rack for storing baseball caps as recited in claim 14 wherein said platform means are oriented and attached to said support member so as to position each corresponding support plane at an obtuse angle to a first axis defined by said length of said support member.

17. A rack for storing baseball caps as recited in claim 16 wherein said rack section means are attached to said support member in groups of first and second rack section means, said first rack section means oriented 180 degrees about said first axis from said second rack section means, and alternate groups of first and second rack section means attached at said periodic intervals oriented at 90 degrees about said first axis from each other; and said support member is twisted at 90 degrees at positions midway between the rack sections so as to facilitate attachment of said alternate groups at 90 degrees to each other.

18. A rack for storing baseball caps as recited in claim 17 further comprising a base for attachment to said bottom end of said vertical support member for setting said rack on a surface.

* * * * *